US008550601B2

(12) United States Patent
Cellura et al.

(10) Patent No.: US 8,550,601 B2
(45) Date of Patent: Oct. 8, 2013

(54) USE OF PHOTORESIST MATERIAL AS AN INTERSTITIAL FILL FOR PZT PRINTHEAD FABRICATION

(75) Inventors: Mark A. Cellura, Webster, NY (US); Peter J. Nystrom, Webster, NY (US); Kock-yee Law, Penfield, NY (US); John Paul Meyers, Rochester, NY (US); Gary Daniel Redding, Victor, NY (US); Yuanjia Zhang, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 85 days.

(21) Appl. No.: 13/069,732

(22) Filed: Mar. 23, 2011

(65) Prior Publication Data

US 2012/0242758 A1 Sep. 27, 2012

(51) Int. Cl.
*B41J 2/045* (2006.01)

(52) U.S. Cl.
USPC ..... 347/68; 347/70; 347/71; 347/72

(58) Field of Classification Search
USPC ..... 347/68–72; 427/100; 29/25.35, 29/890.1; 310/331
See application file for complete search history.

(56) References Cited

U.S. PATENT DOCUMENTS 6,209,994 B1 * 4/2001 Furuhata et al. ..... 347/68
2008/0239022 A1 10/2008 Andrews et al.
2008/0299396 A1 * 12/2008 Lin et al. ..... 428/411.1

OTHER PUBLICATIONS

Dolan et al., "Polymer Layer Removal on PZT Arrays a Using Plasma Etch", U.S. Appl. No. 13/011,409, filed Jan. 21, 2011.

* cited by examiner

*Primary Examiner* — Henok Legesse
(74) *Attorney, Agent, or Firm* — MH2 Technology Law Group LLP

(57) ABSTRACT

An ink jet printhead including a plurality of piezoelectric elements and a photosensitive interstitial layer which fills spaces between each adjacent piezoelectric element. The ink jet printhead can be formed using a simplified method to pattern the photosensitive interstitial layer, and to remove a diaphragm attach material which covers a plurality of openings through a diaphragm using laser ablation.

7 Claims, 8 Drawing Sheets

USE OF PHOTORESIST MATERIAL AS AN INTERSTITIAL FILL FOR PZT PRINTHEAD FABRICATION

FIELD OF THE INVENTION

The present teachings relate to the field of ink jet printing devices and, more particularly, to a high density piezoelectric ink jet printhead and methods of making a high density piezoelectric ink jet printhead.

BACKGROUND OF THE INVENTION

Drop on demand ink jet technology is widely used in the printing industry. Printers using drop on demand ink jet technology can use either thermal ink jet technology or piezoelectric technology. Even though they are more expensive to manufacture than thermal ink jets, piezoelectric ink jets are generally favored as they can use a wider variety of inks and eliminate problems with kogation.

Piezoelectric ink jet printheads typically include a flexible diaphragm and a piezoelectric element attached to the diaphragm. When a voltage is applied to the piezoelectric element, typically through electrical connection with an electrode electrically coupled to a voltage source, the piezoelectric element vibrates, causing the diaphragm to flex which expels a quantity of ink from a chamber through a nozzle. The flexing further draws ink into the chamber from a main ink reservoir through an opening to replace the expelled ink.

Increasing the printing resolution of an ink jet printer employing piezoelectric ink jet technology is a goal of design engineers. Increasing the jet density of the piezoelectric ink jet printhead can increase printing resolution. One way to increase the jet density is to eliminate manifolds which are internal to a jet stack. With this design, it is preferable to have a single port through the back of the jet stack for each jet. The port functions as a pathway for the transfer of ink from the reservoir to each jet chamber. Because of the large number of jets in a high density printhead, the large number of ports, one for each jet, must pass vertically through the diaphragm and between the piezoelectric elements.

Manufacturing a high density ink jet printhead assembly having an external manifold has required new processing methods. More accurate and simplified methods for manufacturing a high-density printhead would be desirable.

SUMMARY OF THE EMBODIMENTS

The following presents a simplified summary in order to provide a basic understanding of some aspects of one or more embodiments of the present teachings. This summary is not an extensive overview, nor is it intended to identify key or critical elements of the present teachings nor to delineate the scope of the disclosure. Rather, its primary purpose is merely to present one or more concepts in simplified form as a prelude to the detailed description presented later.

A method for forming an ink jet printhead can include attaching a diaphragm attach material to a diaphragm, wherein the diaphragm comprises a plurality of openings therethrough, and attaching a plurality of piezoelectric elements to the diaphragm. A photosensitive interstitial layer can be dispensed to fill spaces between adjacent piezoelectric elements and to contact the diaphragm and the diaphragm attach material, wherein the diaphragm attach material prevents the flow of the photosensitive interstitial layer through the plurality of openings in the diaphragm. The photosensitive interstitial layer which contacts the diaphragm attach material can be removed, while leaving the photosensitive interstitial layer in the spaces between adjacent piezoelectric elements. With the photosensitive interstitial layer in the spaces between adjacent piezoelectric elements, the plurality of piezoelectric elements can be attached to a plurality of electrodes to provide an electrical pathway between each piezoelectric element and the electrode attached thereto.

In accordance with another embodiment of the present teachings, an ink jet printhead can include a jet stack. The jet stack can include a plurality of piezoelectric elements, a space between each adjacent piezoelectric element, wherein each space between adjacent piezoelectric elements is filled with a photosensitive material, a diaphragm attached to the plurality of piezoelectric elements, and a body plate attached to the diaphragm with a diaphragm attach material. The printer can further include a printed circuit board attached to the photosensitive material and comprising a plurality of electrodes, wherein each of the plurality of electrodes is electrically coupled to one of the plurality of piezoelectric elements with a conductor.

In another embodiment, a printer can include a jet stack, where the jet stack can include a diaphragm having a plurality of openings therein, a plurality of piezoelectric elements attached to the diaphragm, a body plate attached to the diaphragm with a diaphragm attach material, and a photosensitive interstitial layer between adjacent piezoelectric elements. The printer can further include a printed circuit board attached to the photosensitive interstitial layer and comprising a plurality of electrodes, wherein each electrode is electrically coupled with a respective piezoelectric element, a plurality of openings extending through the printed circuit board, the photosensitive interstitial layer, the diaphragm, and the diaphragm attach material, and a manifold attached to the printed circuit board. An ink reservoir can be defined by an interior surface of the manifold and a surface of the printed circuit board.

BRIEF DESCRIPTION OF THE DRAWINGS

The accompanying drawings, which are incorporated in and constitute a part of this specification, illustrate embodiments of the present teachings and together with the description, serve to explain the principles of the disclosure. In the figures.

It should be noted that some details of the FIGS. have been simplified and are drawn to facilitate understanding of the inventive embodiments rather than to maintain strict structural accuracy, detail, and scale. Some elements may not be depicted or described for simplicity of explanation and/or because they are not immediately relevant to the present teachings.

DESCRIPTION OF THE EMBODIMENTS

Reference will now be made in detail to embodiments of the present teachings, examples of which is illustrated in the accompanying drawings. Wherever possible, the same reference numbers will be used throughout the drawings to refer to the same or like parts.

As used herein, the word "printer" encompasses any apparatus that performs a print outputting function for any purpose, such as a digital copier, bookmaking machine, facsimile machine, a multi-function machine, etc. The word "photoresist" encompasses any one of a broad range of photosensitive materials including positive photoresists such as positive-tone photodefinable polybenzobisoxazole (PBO), negative-tone photosensitive polyimides such as photodefinable epoxies or negative-tone photosensitive polyimides, and related compounds known to the art. The word "polymer" encompasses any one of a broad range of carbon-based compounds formed from long-chain molecules including thermoset polyimides, thermoplastics, resins, polycarbonates, epoxies, and related compounds known to the art.

Embodiments of the present teachings can include the use of a photoresist as an interstitial layer between adjacent piezoelectric elements on a jet stack of an ink jet printhead. The photoresist interstitial layer remains as part of the printhead during printing of an image using the printhead. The use of photoresist as the interstitial layer can result in reduced processing acts compared to prior processes, as well as a reduced number of masks or reticles to form the printhead, thereby reducing manufacturing costs. Additionally, the formation of an opening for the passage of ink through a diaphragm subsequent to forming the interstitial layer can be performed using laser ablation. The opening can be formed by removing only one thin layer, compared to prior processes which can require the removal of several layers.

Figure 1:
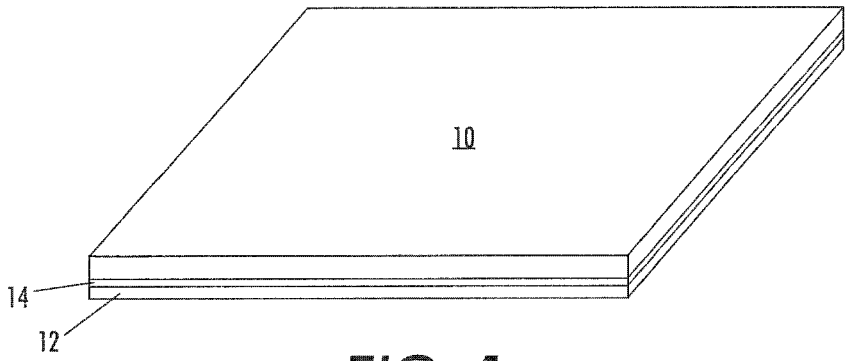
FIGS. 1 and 2 are perspective views of intermediate piezoelectric elements of an in-process device in accordance with an embodiment of the present teachings.

In the perspective view of FIG. 1, a piezoelectric element layer 10 is detachably bonded to a transfer carrier 12 with an adhesive 14. The piezoelectric element layer 10 can include, for example, a lead-zirconate-titanate layer, for example between about 25 μm to about 150 μm thick to function as an inner dielectric. The piezoelectric element layer 10 can be plated on both sides with nickel, for example, using an electroless plating process to provide conductive elements on each side of the dielectric PZT. The nickel-plated PZT functions ebberitially as a parallel plate capacitor which develops a difference in voltage potential across the inner PZT material. The carrier 12 can include a metal sheet, a plastic sheet, or another transfer carrier. The adhesive layer 14 which attaches the piezoelectric element layer 10 to the transfer carrier 12 can include a dicing tape, thermoplastic, or another adhesive, in another embodiment, the transfer carrier 12 can be a material such as a self-adhesive thermoplastic layer such that a separate adhesive layer 14 is not required.

Figure 2:
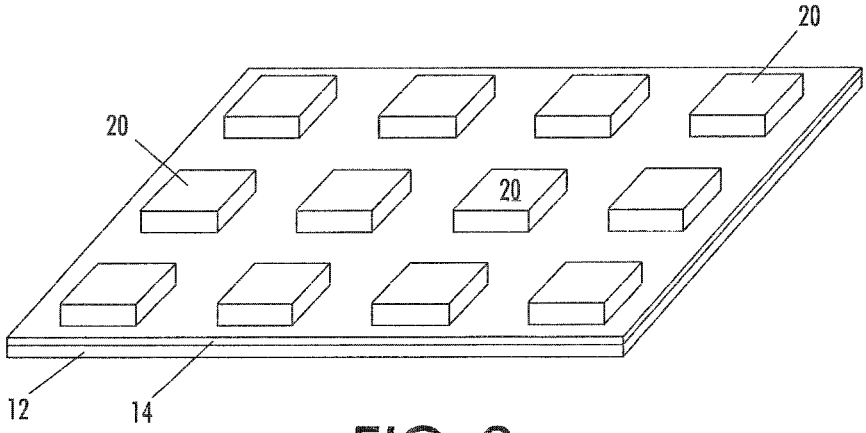

After forming the FIG. 1 structure, the piezoelectric element layer 10 is diced to form a plurality of individual piezoelectric elements 20 as depicted in FIG. 2. It will be appreciated that while FIG. 2 depicts 4×3 array of piezoelectric elements, a larger array can be formed. For example, current printheads can have a 344×20 array of piezoelectric elements. The dicing can be performed using mechanical techniques and can employ a wafer dicing saw, a dry etch process, laser ablation, etc. To ensure complete separation of each adjacent piezoelectric element 20, the dicing process can be targeted to terminate after removing a portion of the adhesive 14 and stopping on the transfer carrier 12, or after dicing through the adhesive 14 and into the carrier 12.

Figure 3:
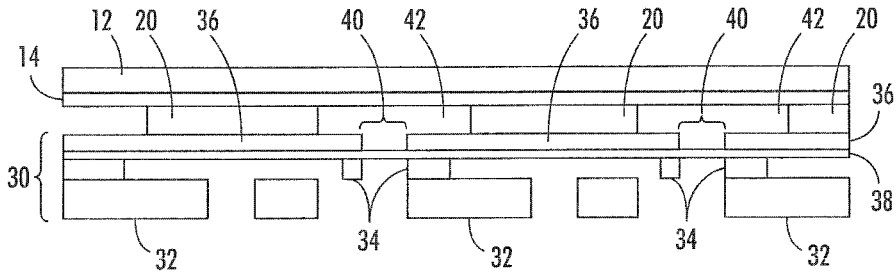
FIGS. 3-11 are cross sections depicting the formation of an ink jet printhead including a jet stack of an in-process device.

After forming the individual piezoelectric elements 20, the FIG. 2 assembly can be attached to a jet stack subassembly 30 as depicted in the cross section of FIG. 3. The FIG. 3 cross section is magnified from the FIG. 2 structure for improved detail, and depicts cross sections of one partial and two complete piezoelectric elements 20. The jet stack subassembly 30 can be manufactured using known techniques. The jet stack subassembly 30 can include, for example, an inlet/outlet plate 32, a body plate 34, and a diaphragm 36 which is attached to the body plate 34 using an adhesive diaphragm attach material 38. The diaphragm 36 can include a plurality of openings 40 for the passage of ink in the completed device as described below. The FIG. 3 structure further includes a plurality of voids 42 which, at this point in the process, can be filled with ambient air. The diaphragm attach material 38 can be a solid sheet of material such as a single sheet polymer so that the openings 40 through the diaphragm 36 are covered.

In an embodiment, the FIG. 2 structure can be attached to the jet stack subassembly 30 using an adhesive between the diaphragm 36 and the piezoelectric elements 20. For example, a measured quantity of adhesive (not individually depicted) can be dispensed, screen printed, rolled, etc., onto either the upper surface of the piezoelectric elements 20, onto the diaphragm 36, or both. In an embodiment, a single drop of adhesive can be placed onto the diaphragm for each individual piezoelectric element 20. After applying the adhesive, the jet stack subassembly 30 and the piezoelectric elements 20 are aligned with each other, then the piezoelectric elements 20 are mechanically connected to the diaphragm 36 with the adhesive. The adhesive is cured by techniques appropriate for the adhesive to result in the FIG. 3 structure.

Subsequently, the transfer carrier 12 and the adhesive 14 are removed from the FIG. 3 structure to result in the structure of FIG. 4.

Figure 4:
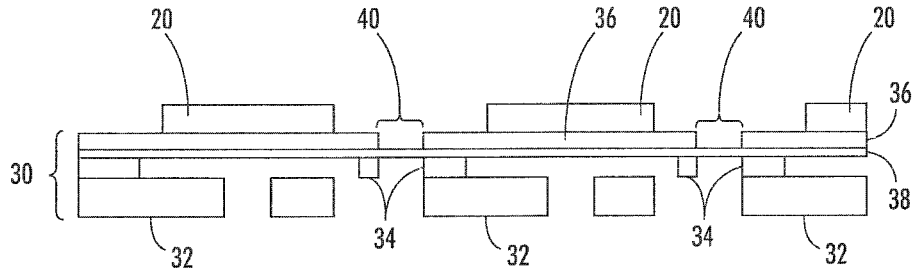

Next, an interstitial layer 50 is dispensed over the FIG. 4 structure. In this embodiment, the interstitial layer 50 can be a photoresist applied onto the surface of the FIG. 4 structure using spin coating to result in the structure of FIG. 5. Generally, photoresists based on photodefinable epoxies, photodefinable polyimides and photodefinable PBO would function sufficiently as the photosensitive interstitial layer for this embodiment. An exemplary photoresist which would be sufficient for use as an interstitial material in this structure includes a negative photoresist such as SU-8, available from MicroChem of Newton, Mass. SU-8 is a line of epoxy-based negative resists which are resistant to solvents, acids, and bases, and have sufficient thermal stability for the use described herein. The primary components in SU-8 include 2-(chloromethyl)oxirane, formaldehyde, 4-[2-(4-hydroxyphenyl)propan-2-yl]phenol and mixed triarylsulfonium/hexafluoroantimonate salt. SU-8 does not experience dimensional changes as a result of being exposed to ultraviolet inks. Another exemplary photoresist is negative-tone photodefinable polyimide precursor HD-4100 series, available from HD MicroSystems of Parlin, N.J. The primary components in HD-4100 series include esterified polyamic acid resin and acrylate ester. Another exemplary photoresist is photosensitive CYCLOTENE 4000 Series resin, available from Dow Chemical Company of Midland, Mich. The primary components in CYCLOTENE 4000 Series are B-Staged divinylsiloxane-bis-benzocyclobutene resin and 2,6-Bis((azidophenyl)methylene)-4-ethylcyclohexanone. It will be understood that the process can be modified by one of ordinary skill in the art for a positive photoresist.

Figure 5:
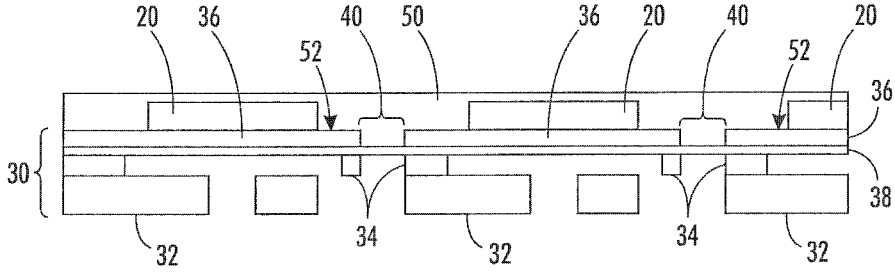

The photoresist can be dispensed in a quantity sufficient to fill the spaces between adjacent piezoelectric elements 20, to cover exposed portions of an upper surface 52 of the diaphragm 36, and to encapsulate the piezoelectric elements 20 as depicted in FIG. 5. The photoresist can further fill the openings 40 within the diaphragm 36 as depicted. Subsequent to dispensing the photoresist interstitial layer 50, the photoresist can be soft-cured using a soft bake process to enhance workability.

The diaphragm attach material 38 which covers openings 40 in the diaphragm prevents the photoresist from passing through the openings Spin coating the photoresist to form the interstitial layer 50 results in a planarized upper surface 54. In other embodiments, planarization can be performed, for example, by material self-leveling or techniques including mechanical wiping and molding under pressure.

Figure 6:
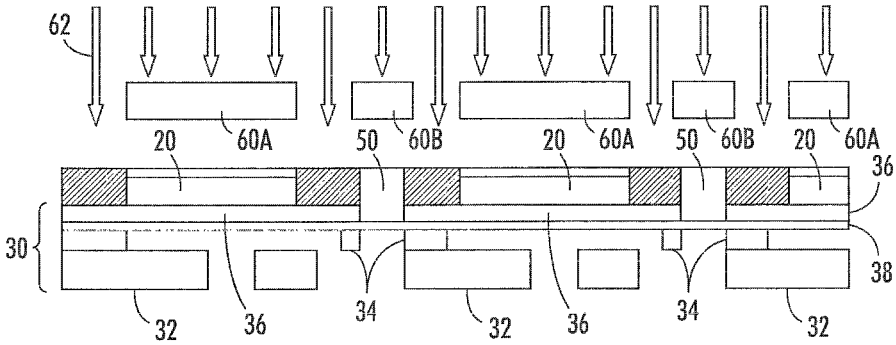

Next, an optical photolithographic process can be used to pattern the photoresist interstitial layer 50. The photolithographic process can employ a mask or reticle 60 (referred to hereinafter collectively as "mask") to pattern light 62 from a light source as depicted in FIG. 6 according to techniques known in the art. The mask 60 can include first portions 60A which cover the piezoelectric elements 20, and second portions 60B which cover the openings 40 through the diaphragm 36. The first portions 60A of the mask will generally align with the piezoelectric elements 20. The channel locations covered by the second portions 60B of the mask will generally align with the openings 40 which extend through the diaphragm 36 and the body plate 34. Exposure to light 62 cross-links the exposed photoresist 50, while the photoresist which is not exposed to light is not cross-linked. As known in the art, cross-linked photoresist is insoluble in a developer, while the photoresist which is not exposed to light 62 can be removed with a developer.

Subsequent to exposing the photoresist interstitial layer 50 to the patterned light 62, the photoresist can undergo a post exposure bake as required for chemical reaction and then exposure to a developer to remove the unexposed portions of the photoresist to leave the exposed portions of the photoresist. The photoresist interstitial layer 50 is removed from the upper surface of the piezoelectric elements 20 and from the openings 40 in the diaphragm 36 such that the upper surface of the piezoelectric elements 20 and the upper and lower surfaces of the diaphragm attach material 38 are exposed. A curing stage can follow as appropriate depending on the type of resist. A structure similar to that depicted in FIG. 7 remains.

Figure 7:
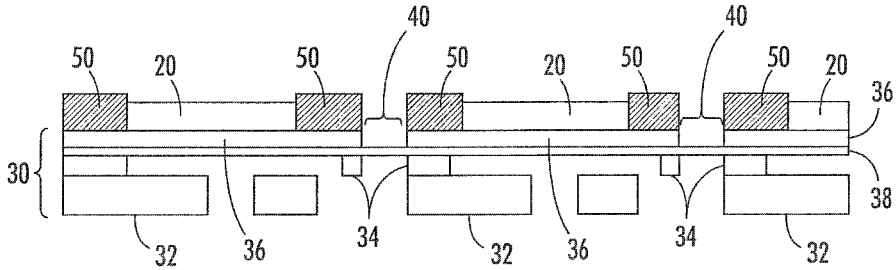
Figure 8:
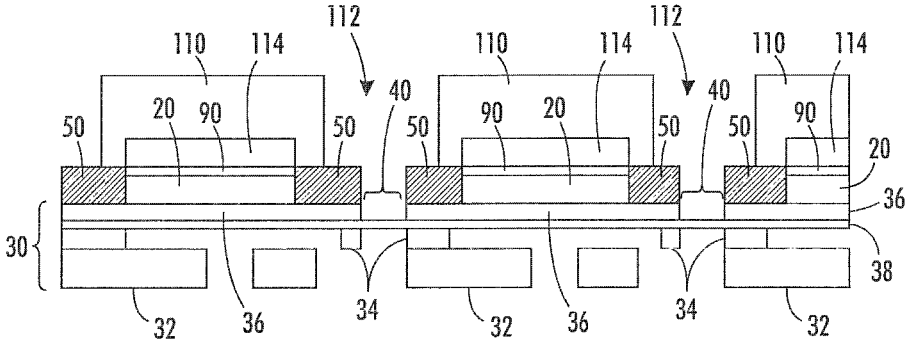

Next, as depicted in FIG. 8, a printed circuit board (PCB) 110 having a plurality of vias 112 and a plurality of electrodes 114 is attached to the FIG. 7 subassembly. A conductor 90 such as a conductive paste can be used to electrically connect each PCB electrode 114 to a piezoelectric element 20 as depicted. The conductor 90 electrically couples the piezoelectric elements 20 to the PCB electrodes 114 such that a conductive path extends from the PCB electrodes 114 through the conductor 90 to the piezoelectric elements 20. Dielectric adhesives (not depicted) can be used in addition to the conductor 90 to provide a more secure physical connection between the PCB 110 and the FIG. 7 subassembly.

Figure 9:
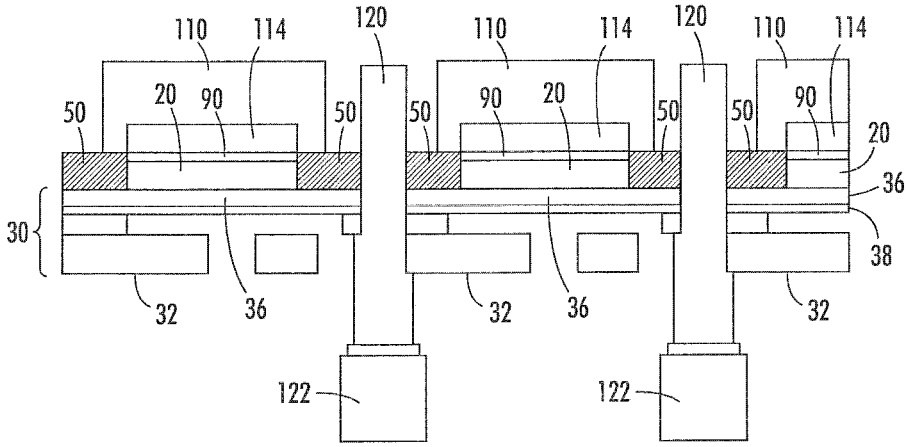
Figure 10:
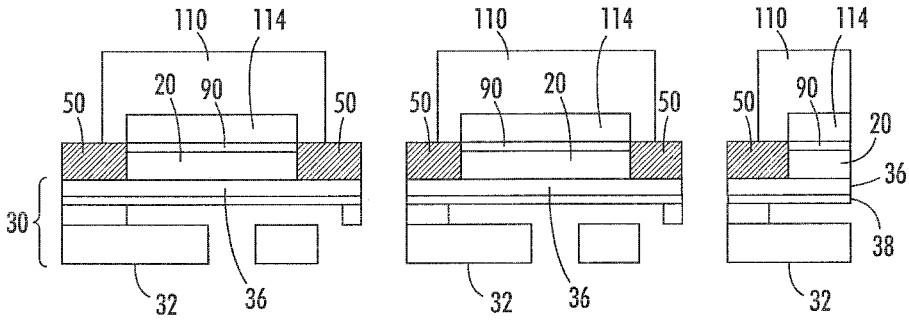

Next, the openings 40 through the diaphragm 36 can be cleared to allow passage of ink through the diaphragm. Clearing the openings includes removing a portion of the diaphragm attach material 38 which covers the opening 40. In various embodiments, chemical or mechanical removal techniques can be used. In an embodiment, a self-aligned removal process can include the use of a laser beam 120 output by a laser 122 as depicted in FIG. 9, particularly where the inlet/outlet plate 32, the body plate 34, and the diaphragm 36 are formed from metal. The inlet/outlet plate 32, the body plate 34 and optionally, depending on the design, the diaphragm 36 can mask the laser beam for a self-aligned laser ablation process. In this embodiment, a laser such as a $CO_2$ laser, an excimer laser, a solid state laser, a copper vapor laser, and a fiber laser can be used. A $CO_2$ laser and an excimer laser can typically ablate polymers including epoxies. A $CO_2$ laser can have a low operating cost and a high manufacturing throughput. While two lasers 122 are depicted in FIG. 9, a single laser beam 120 can open each hole in sequence using one or more laser pulses. In another embodiment, two or more openings can be made in a single operation. A $CO_2$ laser beam that can over-fill the mask provided by the inlet/outlet plate 32, the body plate 34, and possibly the diaphragm 36 could sequentially illuminate each opening 40 to form the extended openings through the diaphragm attach material 38 to result in the FIG. 10 structure. As depicted in FIG. 10, the photoresist 50 physically contacts the diaphragm 36, each piezoelectric element 20, and the PCB 110.

Figure 11:
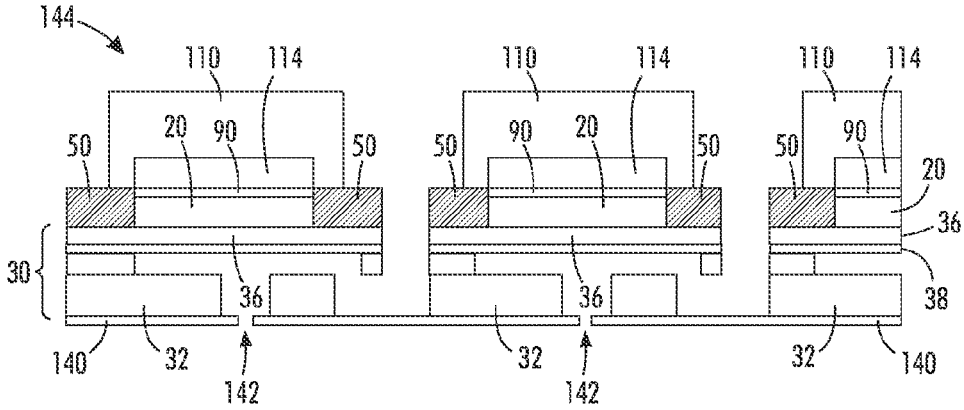

Next, an aperture plate 140 can be attached to the inlet/outlet plate 32 with an adhesive (not individually depicted) as depicted in FIG. 11. The aperture plate 140 includes nozzles 142 through which ink is expelled during printing. Once the aperture plate 142 is attached, the jet stack 144 is complete.

Figure 12:
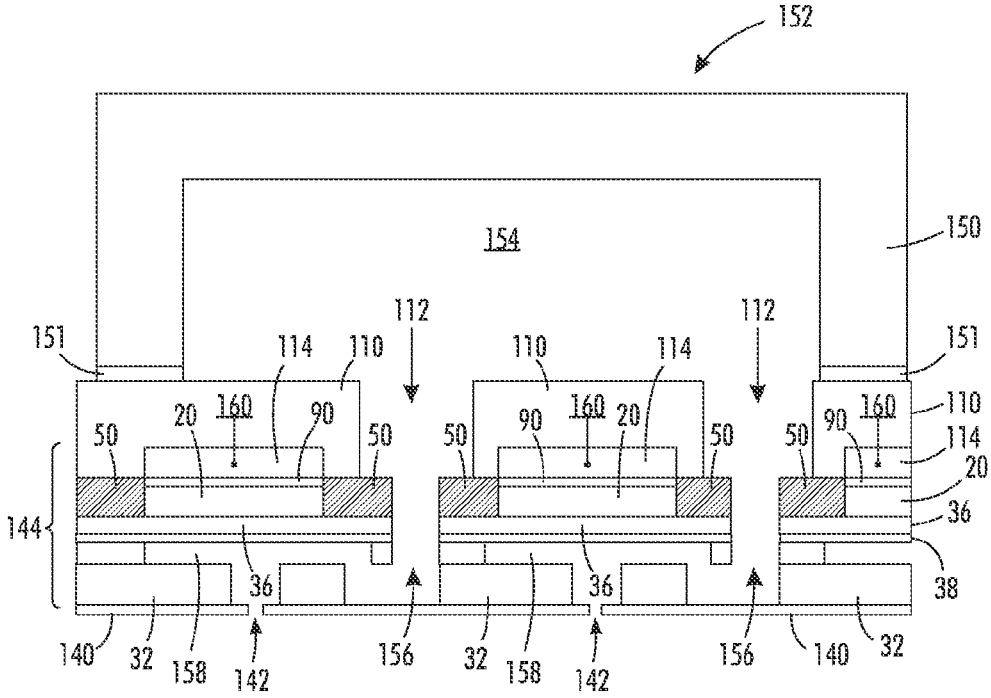
FIG. 12 is a cross section of a printhead including a jet stack.

Subsequently, a manifold 150 is bonded to the PCB 110, for example using a fluid-tight sealed connection 151 such as an adhesive to result in an ink jet printhead 152 as depicted in FIG. 12. The ink jet printhead 152 can include a reservoir 154 defined by an interior surface of the manifold 150 and a surface of the PCB 110, wherein the reservoir 154 is adapted to store a volume of ink. Ink from the reservoir 154 is delivered through the vias 112 in the PCB 110 to ink ports 156 within the jet stack 144. It will be understood that FIG. 12 is a simplified view, and may have additional structures to the left and right of the FIG. For example, while FIG. 12 depicts two ink ports 156, a typical jet stack can have, for example, a 344×20 array of ports.

In use, the reservoir $^{4}$154 in tile manifold 150 of It printhead 152 includes a volume of ink. An initial priming of the printhead can be employed to cause ink to flow from the reservoir 154, through the vias 112 in the PCB 110, through the ports 156 in the jet stack 144, and into chambers 158 in the jet stack 144. Responsive to a voltage 160 placed on each electrode 114, each PZT piezoelectric element 20 vibrates at an appropriate time in response to a digital signal. The vibration of the piezoelectric element 20 causes the diaphragm 36 to flex which creates a pressure pulse within the chamber 158 causing a drop of ink to be expelled from the nozzle 142.

The methods and structure described above thereby form a jet stack 144 for an ink jet printer. In an embodiment, the jet stack 144 can be used as part of an ink jet printhead 152 as depicted in FIG. 12.

Figure 13:
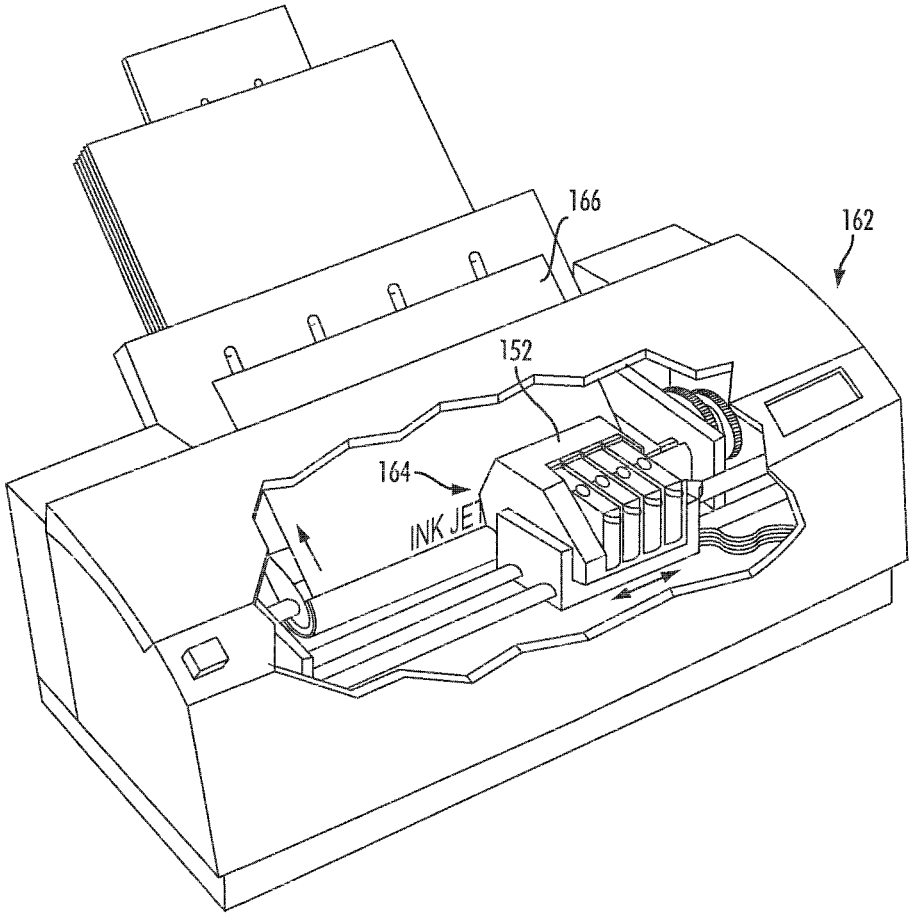
FIG. 13 is a printing device including a printhead according to an embodiment of the present teachings.

FIG. 13 depicts a printer 162 including one or more printheads 152 and ink 164 being ejected from one or more nozzles 142 in accordance with an embodiment of the present teachings. The printhead 152 is operated in accordance with digital instructions to create a desired image on a print medium 166 such as a paper sheet, plastic, etc. The printhead 152 may move back and forth relative to the print medium 166 in a scanning motion to generate the printed image swath by swath. Alternately, the printhead 152 may be held fixed and the print medium 166 moved relative to it, creating an image as wide as the printhead 152 in a single pass. The printhead 152 can be narrower than, or as wide as, the print medium 166.

The method for forming a jet stack, a printhead, and a printer according to the present teachings can result in a well-formed jet stack. For example, as depicted in FIGS. 8 and 9, the laser beam 120 is iequired to clear only a single layer of material. In this embodiment, the material includes the diaphragm attach material 38, which can be a solid sheet of material such as a single sheet polymer. The single sheet polymer can have a thickness of between about 25 micrometers (μm) and about 50 μm. A laser beam 120 such as that produced by an excimer laser can remove this polymer thickness with little or no residue by vaporizing the polymer diaphragm attach material 38. Additionally, since the polymer is a single sheet, it can include a uniform thickness with little thickness variation, which is well-suited for removal by a laser beam. Additionally, since the thickness of material removed is small, an opening having little or no taper can be formed through the polymer, which improves the flow of ink from the ink reservoir 154 through the port 156 and the opening 40 within the diaphragm 38.

Additionally a single mask 60 is required to pattern the photoresist interstitial layer 50 to expose the top surface of the piezoelectric electrodes 20 and to expose the diaphragm attach material 38, for example as depicted in FIGS. 6 and 7. This reduces the number of processing stages and masks required to form the structure when contrasted with prior processes, which reduces the overall cost of manufacture.

It will be realized that the present teachings can include other method acts which have been omitted for simplicity. For example, the process can include substrate conditioning, for example the formation of an adhesion layer, to ensure that the photoresist adheres to exposed surfaces. Embodiments can further include, after coating the structure with the photoresist, a soft bake of the photoresist, exposure of the photoresist to light patterned by a mask, a post exposure bake process of the photoresist, a develop process to remove the unexposed photoresist, for example using a developer, a rinse to remove photoresist residue after developing, and/or a post rinse drying process and/or a curing process.

Figure 14:
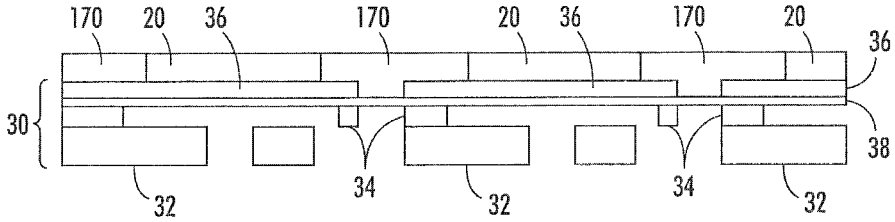
FIGS. 14-16 are cross sections of in-process structures depicting the formation of an ink jet printhead including a jet stack according to another embodiment of the present teachings.

Other embodiments will become apparent from the teachings herein. For example, another embodiment can begin with the FIG. 4 structure. Subsequently, a photoresist interstitial layer 170 is dispensed onto the FIG. 4 structure as depicted in FIG. 14. The photoresist is applied so as to fill spaces between the piezoelectric elements 20, but not to cover the tops of the piezoelectric elements 20 as depicted in FIG. 14. Application of the photoresist interstitial layer 170 can be performed by spin coating, which can achieve a sufficiently planar photoresist surface. In other embodiments, the photoresist interstitial layer 170 can be applied by blade, draw down bar, flow coating, etc. In this embodiment, the use of a positive photoresist is demonstrated, but it will be understood that the process can be modified for use with a negative photoresist. Generally, photoresists based on photodefinable epoxies, photodefinable polyimides, and photodefinable PBO would function sufficiently as the photosensitive interstitial layer. Exemplary materials which may function sufficiently include positive-tone resists such as HD-8800 series available from HD MicroSystems of Parlin, N.J. HD-8800 series is a photodefinable PBO precursor, primarily including polyamide and a photoinitiator.

Figure 15:
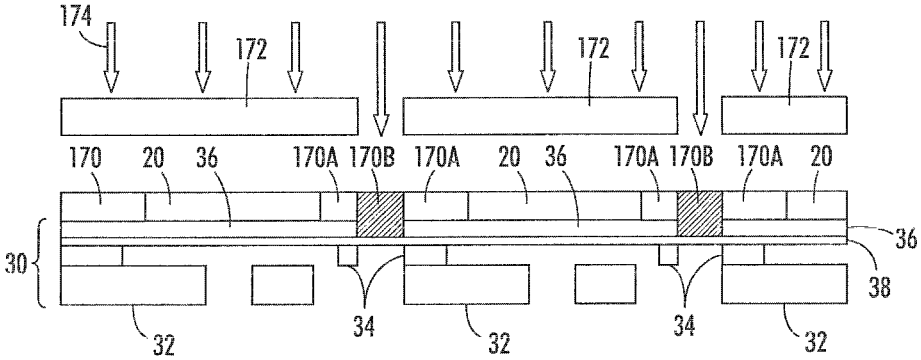

Next, an optical photolithographic process can be used to pattern the photoresist interstitial layer 170. The photolithographic process can employ a mask 172 to pattern light 174 from a light source as depicted in FIG. 15 according to techniques known in the art. In this embodiment, the mask allows light to illuminate the photoresist 170 at the openings 40 (FIG. 4) through the diaphragm 38, and block the light over all other regions. In an alternate embodiment, it is contemplated that a mask can be used which allows light to illuminate the regions of the piezoelectric elements 20, in case the photoresist 172 overlies the piezoelectric elements 20 either intentionally or through processing errors.

Figure 16:
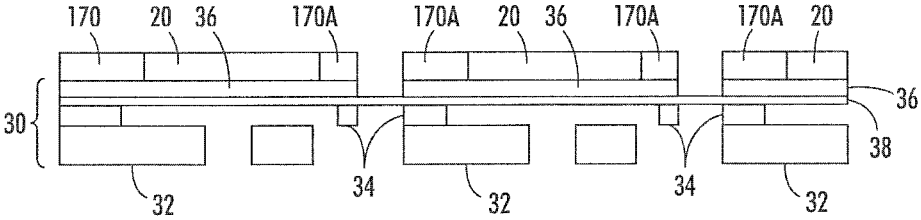

In this embodiment, exposing the photoresist interstitial layer 170 to light alters the chemical structure of the photoresist so that exposed regions 170B become soluble in a developer, while the unexposed regions 170A are insoluble in the developer. After exposing regions 170B of the photoresist interstitial layer 170, the photoresist is exposed to an appropriate developer to remove exposed portions 170B to result in the FIG. 16 structure. A curing stage can follow as appropriate, in order to remove residual solvents and to complete the cyclization process to produce a PBO film and complete the adhesion process. Processing of the FIG. 16 structure can continue using a process similar to that performed on the FIG. 7 structure as described above to form a jet stack similar to jet stack 144 depicted in FIG. 11, a printhead similar to printhead 152 depicted in FIG. 12, and a printer similar to printer 162 depicted in FIG. 13.

Notwithstanding that the numerical ranges and parameters setting forth the broad scope of the present teachings are approximations, the numerical values set forth in the specific examples are reported as precisely as possible. Any numerical value, however, inherently contains certain errors necessarily resulting from the standard deviation found in their respective testing measurements. Moreover, all ranges disclosed herein are to be understood to encompass any and all sub-ranges subsumed therein. For example, a range of "less than 10" can include any and all sub-ranges between (and including) the minimum value of zero and the maximum value of 10, that is, any and all sub-ranges having a minimum value of equal to or greater than zero and a maximum value of equal to or less than 10, e.g., 1 to 5. In certain cases, the numerical values as stated for the parameter can take on negative values. In this case, the example value of range stated as "less than 10" can assume negative values, e.g., −1, −2, −3, −10, −20, −30, etc.

While the present teachings have been illustrated with respect to one or more implementations, alterations and/or modifications can be made to the illustrated examples without departing from the spirit and scope of the appended claims. In addition, while a particular feature of the disclosure may have been described with respect to only one of several implementations, such feature may be combined with one or more other features of the other implementations as may be desired and advantageous for any given or particular function. Furthermore, to the extent that the terms "including," "includes," "having," "has," "with," or variants thereof are used in either the detailed description and the claims, such terms are intended to be inclusive in a manner similar to the term "comprising." The term "at least one of" is used to mean one or more of the listed items can be selected. Further, in the discussion and claims herein, the term "on" used with respect to two materials, one "on" the other, means at least some contact between the materials, while "over" means the materials are in proximity, but possibly with one or more additional intervening materials such that contact is possible but not required. Neither "on" nor "over" implies any directionality as used herein. The term "conformal" describes a coating material in which angles of the underlying material are preserved by the conformal material. The term "about" indicates that the value listed may be somewhat altered, as long as the alteration does not result in nonconformance of the process or structure to the illustrated embodiment. Finally, "exemplary" indicates the description is used as an example, rather than implying that it is an ideal. Other embodiments of the present teachings will be apparent to those skilled in the art from consideration of the specification and practice of the disclosure herein. It is intended that the specification and examples be considered as exemplary only, with a true scope and spirit of the present teachings being indicated by the following claims.

Terms of relative position as used in this application are defined based on a plane parallel to the conventional plane or working surface of a wafer or substrate, regardless of the orientation of the wafer or substrate. The term "horizontal" or "lateral" as used in this application is defined as a plane parallel to the conventional plane or working surface of a wafer or substrate, regardless of the orientation of the wafer or substrate. The term "vertical" refers to a direction perpendicular to the horizontal. Terms such as "on," "side" (as in "sidewali"), "higher," "lower," "over," "top," and "under" are defined with respect to the conventional plane or working surface being on the top surface of the wafer or substrate, regardless of the orientation of the wafer or substrate.

The invention claimed is:

1. An ink jet printhead comprising:

a jet stack comprising:

a plurality of piezoelectric elements;

a space between each adjacent piezoelectric element, wherein each space between adjacent piezoelectric elements is filled with a photoresist material;

a diaphragm attached to the plurality of piezoelectric elements; and a body plate attached to the diaphragm with a diaphragm attach material;

a printed circuit board attached to the photoresist material and comprising:

a plurality of electrodes, wherein each of the plurality of electrodes is electrically coupled to one of the plurality of piezoelectric elements with a conductor and;

wherein each of the plurality of piezoelectric elements comprises an upper surface;

an entirety of each upper surface of each piezoelectric element is not covered by the photoresist material; and wherein the photoresist material physically contacts the printed circuit board, the diaphragm and the plurality of peizoelectric elements.

2. The ink jet printhead of claim 1, wherein the photoresist material is a cross-linked negative photoresist.

3. The ink jet printhead of claim 1, wherein the photoresist material is a positive photoresist.

4. A printer, comprising:

a jet stack, comprising:

a diaphragm having a plurality of openings therein;

a plurality of piezoelectric elements attached to the diaphragm;

a body plate attached to the diaphragm with a diaphragm attach material; and a photoresist interstitial layer between adjacent piezoelectric elements;

a printed circuit board attached to the photoresist interstitial layer and comprising a plurality of electrodes, wherein each electrode is electrically coupled with a respective piezoelectric element;

a plurality of openings extending through the printed circuit board, the photoresist interstitial layer, the diaphragm, and the diaphragm attach material;

a manifold attached to the printed circuit board;

an ink reservoir defined by an interior surface of the manifold and a surface of the printed circuit board; and wherein each of the plurality of piezoelectric elements comprises an upper surface;

an entirety of each upper surface of each piezoelectric element is not covered by the photoresist interstitial layer; and wherein the photoresist interstitial layer physically contacts the printed circuit board, the diaphragm and the plurality of piezoelectric elements.

5. The printer of claim 4, wherein the photoresist interstitial layer is a cross-linked negative photoresist.

6. The printer of claim 4, wherein the photoresist layer is a positive photoresist.

7. The printer of claim 4, wherein the photoresist interstitial layer is a material selected from the group consisting of photodefinable epoxies, photodefinable polyimides, and photodefinable polybenzobisoxazole (PBO).

* * * * *